US007028993B2

(12) United States Patent
Burns

(10) Patent No.: US 7,028,993 B2
(45) Date of Patent: Apr. 18, 2006

(54) CHARGE FORMING APPARATUS

(75) Inventor: Micahel P. Burns, Millington, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 157 days.

(21) Appl. No.: 10/625,981

(22) Filed: Jul. 24, 2003

(65) Prior Publication Data

US 2005/0017378 A1 Jan. 27, 2005

(51) Int. Cl.
*F02M 17/04* (2006.01)

(52) U.S. Cl. ..... 261/35; 261/63; 261/69.1; 261/DIG. 74

(58) Field of Classification Search ..... 261/35, 261/63, 69.1, DIG. 74
See application file for complete search history.

(56) References Cited

U.S. PATENT DOCUMENTS

| | | | | |
|---|---|---|---|---|
| 2,216,422 A | | 10/1940 | Schimanek | 261/69.2 |
| 3,174,732 A | | 3/1965 | Brown | 261/69.2 |
| 4,208,358 A | * | 6/1980 | Atkins et al. | 261/50.1 |
| 4,931,226 A | | 6/1990 | Ishii | 261/41.5 |
| 5,073,307 A | | 12/1991 | Langer et al. | 261/35 |
| 5,632,248 A | * | 5/1997 | Sugii | 123/438 |
| 5,843,345 A | * | 12/1998 | Guntly | 261/34.2 |
| 6,561,496 B1 | * | 5/2003 | Gliniecki et al. | 261/52 |
| 6,581,916 B1 | * | 6/2003 | Shaw | 261/35 |
| 6,698,727 B1 | * | 3/2004 | Shaw | 261/35 |

FOREIGN PATENT DOCUMENTS

| | | |
|---|---|---|
| BE | 406646 | 1/1935 |
| DE | 198 09 473 A1 | 10/1999 |

* cited by examiner

*Primary Examiner*—Richard L. Chiesa
(74) *Attorney, Agent, or Firm*—Reising, Ethington, Barnes, Kisselle, P.C.

(57) ABSTRACT

A charge forming apparatus for delivering a controlled mixture of fuel-and-air to an engine has a butterfly-type throttle-choke valve disposed in a fuel-and-air mixing passage. Incoming air flowing through a downstream primary venturi of the mixing passage creates a strong negative pressure which induces fuel flow through a feed passage into the venturi from a fuel metering chamber held at near atmospheric pressure. When the engine is decelerating, substantial closure of the choke valve creates a secondary venturi having a vacuum which dynamically counters the effect of the primary venturi vacuum reducing fuel flow through the feed passage and causing the engine to run leaner and preventing egine stalls and reducing emmissions.

22 Claims, 4 Drawing Sheets

CHARGE FORMING APPARATUS

FIELD OF THE INVENTION

The present invention relates to a charge forming apparatus or carburetor, and more particularly to a charge forming apparatus having a throttling choke valve.

BACKGROUND OF THE INVENTION

Conventional carburetors for internal fuel combustion engines are known to have a fuel-and-air mixing passage for delivering a controlled ratio of fuel-and-air to the combustion chamber of a running two or four cycle engine. The mixing passage is defined by a body of the carburetor and has a venturi disposed between an upstream or air inlet region and a downstream or mixture outlet region of the passage. Generally controlling the amount of air flowing through the venturi is a butterfly-type choke valve disposed pivotally within the air inlet region of the mixing passage. During engine cold-start conditions, the choke valve is in a substantially closed position allowing only a small amount of air to flow through the mixing passage and thus creating the needed rich mixture of fuel-and-air for easy engine cold starts. Otherwise, during warm engine starts and warm running engine conditions, the choke valve is substantially open creating minimal air flow restriction. Generally controlling the flow rate of the fuel-and-air mixture flowing through an intake manifold to the combustion chamber of a running engine is a butterfly-type throttle valve, which is disposed within the mixture outlet region of the mixing passage. As the throttle valve rotates from a substantially closed position to a wide open throttle position, and with the choke valve in a substantially open position, the engine speed will increase from idle to maximum or full power.

Typically, a pressure differential measured between a substantially constant pressure fuel metering chamber of a metering assembly and the high vacuum venturi region of the mixing passage causes liquid fuel to flow from the fuel metering chamber and into the venturi region via a fuel feed passage and a fuel nozzle disposed at a radially inward portion of the venturi or venturi region of the mixing passage. As air flow increases through the venturi, dictated by the position of the throttle valve and the air demand of the combustion engine, the venturi vacuum increases thus causing the fuel flow through the fuel feed passage and nozzle to increase. In this way, an engine initially at idle speed will increase in rpm to wide open throttle conditions with the increasing flow rate of the fuel-and-air mixture.

The fuel metering chamber is held at near atmospheric conditions and near constant volume by a flexible diaphragm disposed directly between the metering chamber and a reference chamber. The metering chamber is defined between a bottom side of the body of the carburetor and a top surface of the diaphragm. The reference chamber is defined between a bottom surface of the diaphragm and a bottom cover of the carburetor which carries an opening or nozzle that vents the reference chamber to atmosphere and/or filtered air. An integral or remote fuel pump, commonly operated via pressure pulses usually from the crankcase of the two cycle engine or the intake manifold of a four cycle engine, supplies fuel to the metering chamber via a supply valve which opens and closes in response to movement of the fuel metering diaphragm.

Of course, many other structural and dynamic factors of the carburetor contribute toward an easy start and smooth running engine which are also required to meet government and regulatory emission requirements. For instance, linkages are known to exist between exterior levers of the choke and throttle valves which make the positions of each valve inter-dependent to a limited degree. Moreover, a plurality of idle and intermediate speed fuel orifices are known to be orientated in the mixture outlet region of the mixing passage on either side of the throttle valve when closed. Such low speed orifices typically communicate with a fuel chamber which receives a controlled amount of fuel from the fuel metering chamber via a supplemental fuel passage. Usually the supplemental fuel passage is restricted controllably by a threaded needle valve which when rotated enters or retracts from the passage thus adjusting the ratio of fuel-to-air in the mixture for stable running conditions at low engine speeds.

Depending upon the engine type, displacement, and application, carburetors can become very complex, having highly machined and detailed bodies which incorporate many more numerous moving parts than those described above. All of this adds to the weight, manufacturing cost and maintenance expense of the carburetor. Likewise, there exist some two cycle engine applications, such as that of small lawn and garden appliances where a more simplistic, lighter, and less expensive carburetor would be ideal. Unfortunately, known carburetors must generally include all the costly components described above to support an easy start and reliable running engine which also meet regulatory emission requirements.

SUMMARY OF THE INVENTION

A charge forming apparatus for delivering a controlled mixture of fuel-and-air to a combustion engine has a butterfly-type choke valve with throttling capability disposed in an air inlet region of a fuel-and-air mixing passage. Fuel is mixed with air in a venturi region of the mixing passage disposed between the air inlet region and a mixture outlet region of the mixing passage. A conventional throttle valve is not disposed in the mixture outlet region since the choke valve performs the throttling function. A strong negative pressure produced at the venturi region, or primary venturi, induces fuel flow through a fuel feed passage into the venturi region from a fuel metering chamber of a fuel metering system. The fuel metering chamber is held at near atmospheric pressure when the throttling choke valve is in a closed position for cold-engine starts or in an open position for running at high engine speeds. When the engine is decelerating and/or when the throttling choke valve is in an idle position, the fuel-and-air mixture ratio becomes leaner to prevent engine stalls and to reduce emissions. The fuel-and-air mixture is "leaned-out" by a secondary venturi disposed upstream of the primary venturi. The vacuum produced by the secondary venturi is substantially weaker than the vacuum produced by the primary venturi. However, the secondary venturi still has a dynamically countering effect to the primary venturi by reducing fuel flow through the fuel feed passage when the throttling choke valve is in the idle position. The secondary venturi is defined between an interior wall which defines the air inlet region and a plate of the throttling choke valve when in the idle position. The small clearance created between the plate and the interior wall produces the high air flow velocity which induces the vacuum exposed to a reference nozzle of a reference passage. The vacuum is transmitted via the reference passage to a reference chamber of the fuel metering system which is separated from the fuel metering chamber by a flexible diaphragm. When the throttling choke valve is not in the idle position, the plate pivots out of the position necessary to create the secondary venturi and the reference chamber is exposed to near atmospheric pressure.

Preferably, the carburetor body defines an air bypass channel which communicates directly between the air inlet region upstream of the choke valve and the mixture outlet region of the mixing passage. A threaded bypass screw or valve controllably restricts the bypass channel to fine tune the fuel-and-air mixture ratio to obtain stable engine running conditions at idling speed. Preferably, when the throttling choke valve is not in the idle position, a rich mixture of fuel-and-air is promoted via a vent passage and an isolation valve which communicates between a near atmospheric air source and the reference passage when the isolation valve is in the open state.

Objects, features, and advantage of this invention include a simplified carburetor which does not have a throttling valve and the associated linkages which would be required to mechanically interact with the choke valve. Moreover, engine stalls due to an overly rich mixture of fuel-and-air are eliminated at idle and deceleration operating conditions thereby providing a reliable smooth running engine with reduced emissions. Additional advantages are a reduced number of manufacturing parts, a design which is economical to manufacture and assemble, and in service has a significantly increased useful life.

DESCRIPTION OF THE DRAWINGS

These and other objects, features and advantages of this invention will be apparent from the following detailed description of the preferred embodiment and best mode, appended claims, and accompanying drawings in which:

DETAILED DESCRIPTION OF THE PREFERRED EMBODIMENTS

Figure 1:
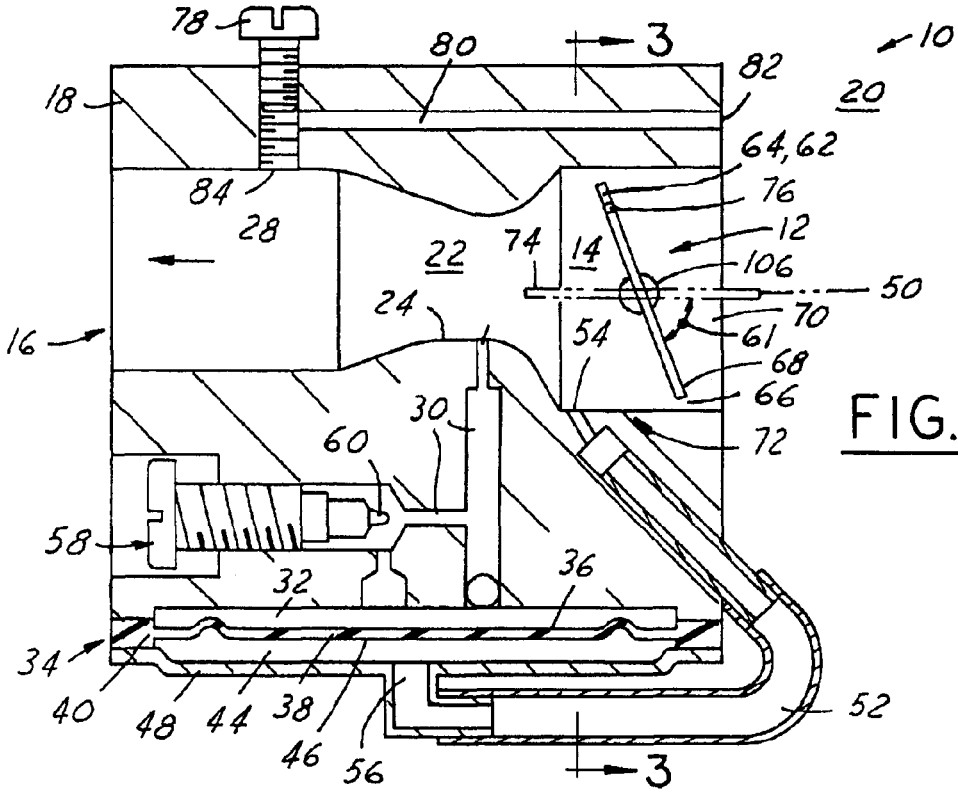
FIG. 1 is a cross-section of a charge forming apparatus of the present invention having a throttling choke valve shown in an idle position and in phantom a closed position.
Figure 2:
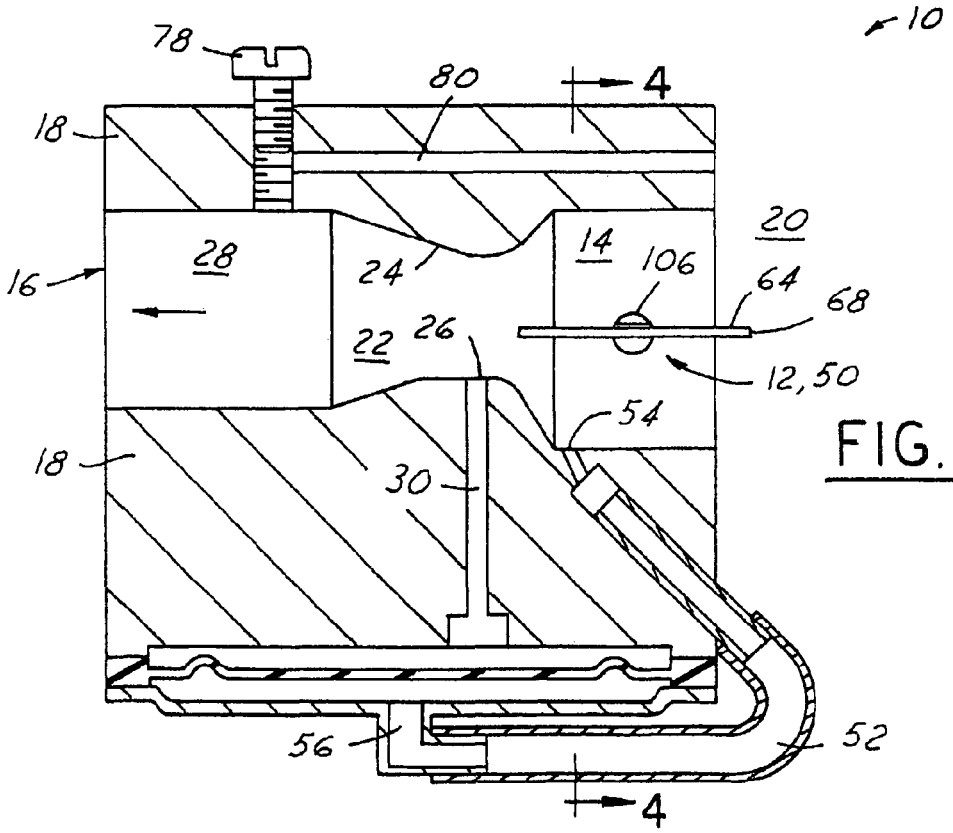
FIG. 2 is the cross-section of the charge forming apparatus of FIG. 1 with the throttling choke valve shown in a wide open position.

Referring in more detail to the drawings, FIGS. 1 and 2 illustrate a charge forming apparatus or carburetor 10 according to the present invention having a butterfly-type throttling choke valve 12, and not having a conventional throttle valve. The throttling choke valve 12 is mounted within an upstream or air inlet region 14 of a fuel-and-air mixing passage 16 defined by and extending through a main body 18 of the carburetor 10. From a substantially atmospheric air source 20, air flows into the air inlet region 14 of the mixing passage 16, flows about and past the throttling choke valve 12, and into a high vacuum venturi region 22 of the mixing passage 16 defined by a primary venturi 24 carried by the body 18. At the venturi region 22, the air mixes with fuel flowing out of a fuel orifice or nozzle 26 disposed at the venturi 24. The mixture of fuel-and-air then flows through a downstream or mixture outlet region 28 of the mixing passage 16, and through an intake manifold of a two or four cycle engine (not shown).

Fuel flows through the fuel nozzle 26 via a fuel feed passage 30 defined by the body 18 and extending between the fuel nozzle 26 and a fuel metering chamber 32 of a fuel metering system 34. The fuel metering system 34 functions as a fuel regulator receiving pressurized liquid fuel from a conventional fuel pump (not shown) and supplying fuel, usually at a sub-atmospheric pressure from the fuel metering chamber 32, to the mixing passage 16 via the fuel feed passage 30 and nozzle 26. The fuel metering chamber 32 is defined by the carburetor body 18 and an upward or first side 36 of a flexible diaphragm 38 sealed along a peripheral edge 40 to the body 18. A dry air reference chamber 44 is defined by a downward or opposite second side 46 of the fuel metering diaphragm 38 and a bottom cover 48. The peripheral edge 40 of the diaphragm 38 is thus compressed and engaged sealably between the body 18 and the cover 48 which engages the body 18 via some form of conventional fasteners (not shown).

Referring to FIG. 2, when the engine is running at full load, typically described as wide-open-throttle, the charge forming apparatus 10 of the present invention operates much like a conventional carburetor. That is, the throttling choke valve 12 is in a full open position 50 permitting maximum air flow to the air intake manifold of the engine. The reference chamber 44 of the fuel metering system 34 is vented to the near atmospheric pressure of the air inlet region 14 via a reference passage or external conduit 52 which extends between a reference orifice 54 disposed at the air inlet region 14 of the mixing passage 16 substantially near the venturi 24 and a connector passage 56 carried by the cover 48. Moreover, the fuel nozzle 26 is exposed to the relatively high vacuum of the primary venturi 24 causing liquid fuel to flow from the fuel metering chamber 32 into the venturi region 22. This flow is induced by the pressure differential between the vacuum created in the venturi region 22 by the primary venturi 24 and the near atmospheric pressure within the fuel metering chamber 32 which is maintained by the reference chamber 44 provided the choke valve 12 remains.

Although not shown, a fuel supply valve is preferably actuated by the diaphragm 38 to supply a quantity of fuel, via the fuel pump, to the fuel metering chamber 32. When the diaphragm 38 flexes sufficiently upward as a result of fuel flowing out through the fuel feed passage 30, a mechanical linkage in contact with an approximate center of the diaphragm preferably pivots moving an obstructing head of the valve off of a valve seat preferably carried by the main body 18 allowing a quantity of fuel to flow through a supply passage from the fuel pump. As the diaphragm flexes downward the mechanical linkage moves the valve head back upon the seat to obstruct further fuel from flowing into the metering chamber 32.

As best shown in FIG. 1, the high speed fuel-and-air mixture ratio can be adjusted via a threaded needle valve adjustment screw 58 engaged threadable to the body 18. The screw 58 has a tip or head 60 which adjustably restricts the fuel feed passage 30 when rotated, thus controlling the liquid fuel flow rate entering the venturi region 22 via the fuel nozzle 26. Referring to FIG. 2, the complexity of the carburetor 10 can be simplified and the manufacturing costs reduced by eliminating the high speed adjustment screw 58 where engine manufacturer performance specifications do not require high speed fuel ratio adjustments.

When the engine is running at less than wide-open-throttle, the charge forming apparatus 10 is unlike conventional carburetors because the single throttling choke valve 12 functions to control the fuel-and-air mixture flow and throttle the speed of the engine by pivoting along arrow 61 between a substantially closed or idle position 62 and the full open position 50 instead of the typical separate throttle valve of the conventional carburetor.

When the operator rotates the throttling choke valve 12 toward the full open position 50 (as best shown in FIG. 2), the air flow rate through the venturi region 22 increases causing an increase in vacuum pressure. The increase in vacuum pressure increases the differential pressure across the fuel feed passage 30 which causes an increase in fuel flow rate through the fuel nozzle 26 of the fuel feed passage 30. With the increase in fuel flow rate and the increase in air flow rate, the fuel-and-air mixture ratio remains substantially constant provided the pressure within the fuel metering chamber 32 remains substantially constant. Moreover, as fuel flows out of the fuel chamber 32, the diaphragm 38 is free to flex upward, thus opening the fuel metering valve to supply make-up fuel to the fuel chamber 32 from the fuel pump.

Unlike conventional carburetors, and during deceleration of a combustion engine, a disc-like plate 64 of the throttling choke valve 12 rotates within the air inlet region 14 of the mixing passage 16 toward the idle position 62 and away from the wide open position 50. When the throttling choke valve 12 is in the idle position 62, the plate obstructs approximately eighty-five to ninety percent of the flow cross sectional area of the air inlet region 14. During the pivoting action of the plate 64 and even when the throttling choke valve 12 reaches the idle position 62, the reference nozzle 54 remains orientated downstream of the plate 64.

Because closure of the throttling choke valve 12 dictates or leads the running speed of the engine, as the plate 64 rotates and the choke valve 12 moves toward the idle position 62, a clearance 66 defined between a circumferential outer edge 68 of the plate 64 and a cylindrical wall 70 of the air inlet region 14 becomes increasingly smaller causing air flow velocity through the clearance 66 or flow rate through the reduced flow area to increase. This velocity has a venturi-like effect which exerts a relatively higher vacuum upon the reference nozzle 54, thus acting as a countering secondary venturi 72 disposed immediately upstream of the main venturi 24. As a result of the secondary venturi 72 vacuum, the pressure within the reference chamber 44 decreases from near or slightly sub-atmospheric to a higher vacuum pressure which decreases the pressure differential across the feed passage 30 to reduce the rate of fuel flow from the fuel metering chamber 44 into the venturi region 22 via the feed passage 30 and nozzle 26, thus decreasing the quantity of the fuel-and-air mixture supplied to the intake manifold of the combustion engine via the mixing passage 16 during deceleration and idle conditions. This vacuum pull transmitted via the reference passage 44 prevents an overly rich mixture of fuel-and-air which would stall the engine during deceleration or at idle. To increase engine rpm from idle, the throttling choke valve 12 is opened toward the full open position 50, which causes the vacuum at the reference nozzle 54 and, thus reference chamber 44 to decrease allowing the quantity of the fuel-and-air mixture to increase for higher rpm and/or greater engine load operating conditions to occur.

During cold start conditions of the engine, the throttling choke valve 12 is generally in a closed position 74. When closed, preferably essentially all of the flow area of the air inlet region is obstructed by the plate 64 except for a bleed hole 76 extending through the plate 64 which allows a small amount of air to flow for engine starting. When closed, the clearance 66 is essentially eliminated and the vacuum effect of the secondary venturi 72 is prevented. However, the mixture outlet region 28, the venturi region 22 and that portion of the air inlet region 14 of the mixing passage 16 disposed downstream of the closed plate 64 are still under a vacuum as a result of the negative pressure pulses transmitted via the intake manifold of the engine during cranking and starting.

This vacuum created by engine cranking, with the throttling choke valve 12 closed, is transmitted via the reference passage 52 into the reference chamber 44, and has the negative or countering effect on the diaphragm 38. This would tend to lean-out the fuel-and-air mixture at a time when a relatively rich mixture is needed for cold starts. However, the diameter or sizing of the fuel and reference nozzles 26, 54 compensates for the negative countering effect of the engine cranking vacuum upon the reference nozzle 54 and a sufficiently rich mixture of fuel-and-air is provided for cold starts. To provide this rich mixture, the cross sectional flow minimum area of the fuel nozzle 26 must be considerably larger than the minimum air flow cross sectional area of the reference nozzle 54. As an example, for a fuel nozzle diameter of 0.71 mm, the reference nozzle diameter is substantially within the range of 0.46 mm to 0.51 mm, depending upon the carburetor 10 application and performance requirements. Preferably, the ratio of the fuel nozzle verse reference nozzle minimum cross sectional areas is in the range of 1.67:1 to 1.50:1. The diameter of the air bleed hole 76 is approximately 3.7 mm, however, the air flowing through it does not produce a venturi-effect upon the reference nozzle 54 and thus does not increase the negative pressure directly at the nozzle 54. Moreover, a preferred ratio range of the surface area of the first side 36 of the diaphragm 38 to the minimum cross sectional flow area of the reference nozzle 54 is generally in the range of 2116:1 to 140:1.

Preferably, the idle speed of the engine is fine tuned or adjusted via an idle adjustment screw valve 78 which is adjusted threadably to partially restrict an air bypass channel 80 defined by the body 18 and extending between a bypass aperture 82 exposed to near atmospheric pressure upstream of the throttling choke valve 12 and a bypass orifice 84 opening into the mixture outlet region 28 of the fuel-and-air mixing passage 16. The idle adjustment screw valve 78 is primarily used to adjust for engine-to-engine variations and is particularly advantageous to meet idle specification requirements of an engine manufacturer. With a fuel nozzle 26 diameter of 0.71 mm, the bypass orifice 84 minimum diameter is preferably approximately 3.7 mm.

Preferably, the throttling choke valve 12 is releasably held in the idle position 62 by an exterior detent lever (not shown) such as that disclosed in U.S. Pat. No. 6,561,496, to Gliniecki et. al., issued May 13, 2003, and incorporated herein by reference.

Figure 3:
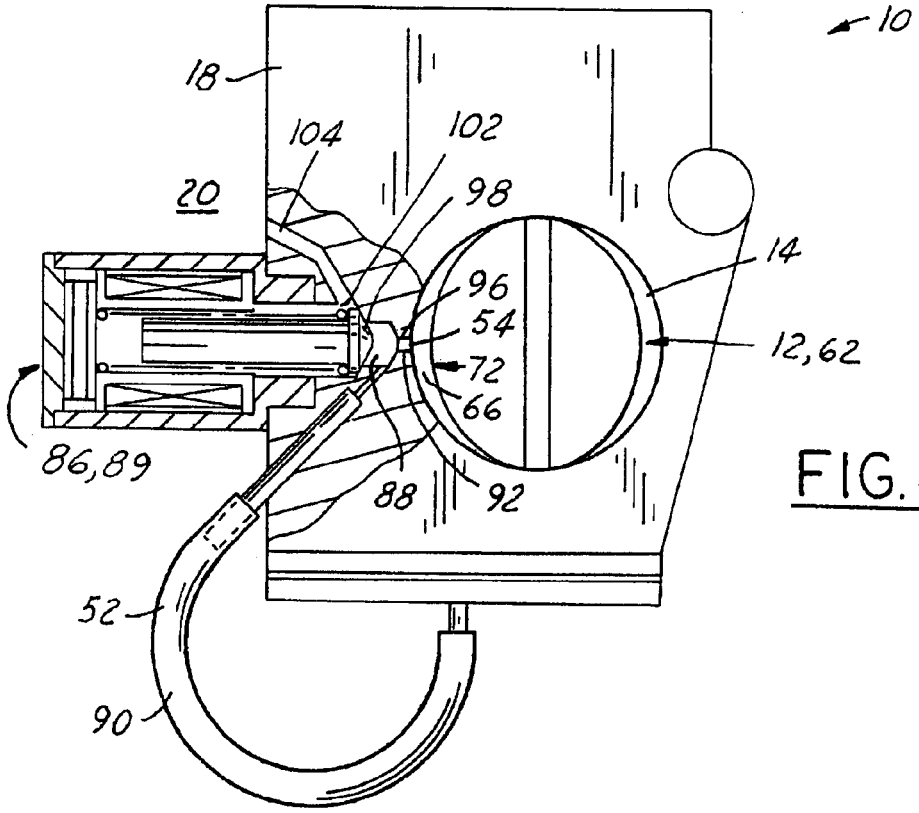
FIG. 3 is a cross-section of the charge forming apparatus having a solenoid-type isolation valve shown in a closed state when the throttling choke valve is in the idle position, and taken along line 3—3 of FIG. 1.
Figure 4:
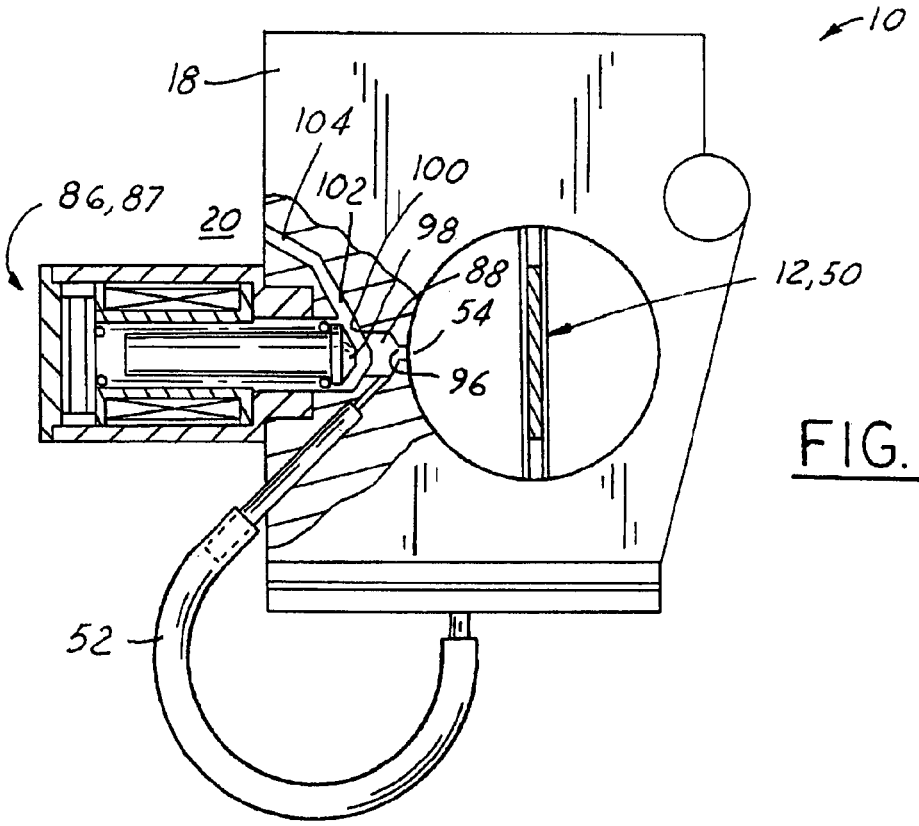
FIG. 4 is the cross-section of the charge forming apparatus of FIG. 3 with the solenoid-type isolation valve shown in an open state when the throttling choke valve is in the open position.

Referring to FIGS. 3 and 4, an additional feature of the present invention is illustrated having an isolation valve 86 of a solenoid-type used for partially diverting the reference passage 52 to the atmospheric air source 20 upstream of the throttling choke valve 12 when the isolation valve 86 is in an open state 87 and the throttling choke valve 12 is in the open position 50 or the closed position 74, but not when the throttling choke valve 12 is in the idle position 62. Exposing the atmospheric pressure source 20 directly to the reference passage 52 promotes a rich fuel-and-air mixture to flow to the intake manifold which is needed for cold starts and for higher than idle rpm running conditions. When the throttling choke valve 12 is in the idle position 62, the isolation valve 86 is in a closed state 89 (as best shown in FIG. 3), depriving the reference chamber 44 of an atmospheric air source in order to promote a lean fuel-and-air mixture.

The carburetor body 18 defines a bore or chamber 88 of the solenoid-type isolation valve 12 which interposes the reference passage 52 into a first and second leg 90, 92. The first leg 90 communicates between the reference chamber 44 and the valve chamber 88 via the reference aperture 56 and a reference port 94 disposed at the valve chamber 88. The second leg 92 communicates between the valve chamber 88 via a vacuum port 96 and the air inlet region 14 via the reference nozzle 54. When isolation valve 86 is in the closed state 89, an actuating member or valve head 98 seats sealably against an annular valve seat 100 carried by the body 18 and exposed within the valve chamber 88. The reference and vacuum ports 94, 96 are orientated on a common side of the seat 100 (or portion of the valve chamber 88). Therefore, the first and second legs 90, 92 are in continuous communication regardless of whether the isolation valve 86 is open or closed, and the reference chamber 44 continuously communicates with at least the reference nozzle 54.

When the throttling choke valve 12 moves out of the idle position 62, the isolation valve 86 moves to the open state 87 (FIG. 4) by moving the valve head 98 axially or linearly away from the seat 100. When valve 86 is open, vent port 102 of a vent passage 104 defined by the body 18 and disposed on an opposite side of the seat 100 from the reference and vacuum ports 94, 96, is in communication with ports 94, 96. Thus, the valve chamber 88 and the reference chamber 44, via the first leg 90 of the reference passage 52, are in communication with the atmospheric air source 20 via the vent passage 104. Because the vent port 102 is separated from the reference and vacuum ports 94, 96 by the valve seat 100, when the actuating member 98 moves linearly to engage the seat 100 and thus moves into the closed state 89, the vent port 102 is isolated from the reference and vacuum ports 94, 96. Therefore, the reference passage 52 communicates only between the reference chamber 44 and the air inlet region 14 via the reference aperture 56 and reference orifice or nozzle 54. When the head 98 of the solenoid-type isolation valve 86 is unseated, all of the ports communicate with each other via the valve chamber 88, thus the vent passage 104 is in communication with the reference passage 52 for reducing the vacuum within the reference chamber 44 and effectively increasing the rate at which the fuel-and-air mixture flows into the intake manifold.

Preferably, the solenoid-type isolation valve 86 is de-energized when in the open state 87 and the throttling choke valve 12 is in the closed position 74 or the open position 50, but not in the idle position 62. In this way, the isolation valve 86 need not be energized when attempting to start the engine with a closed throttling choke valve 12.

Figure 5:
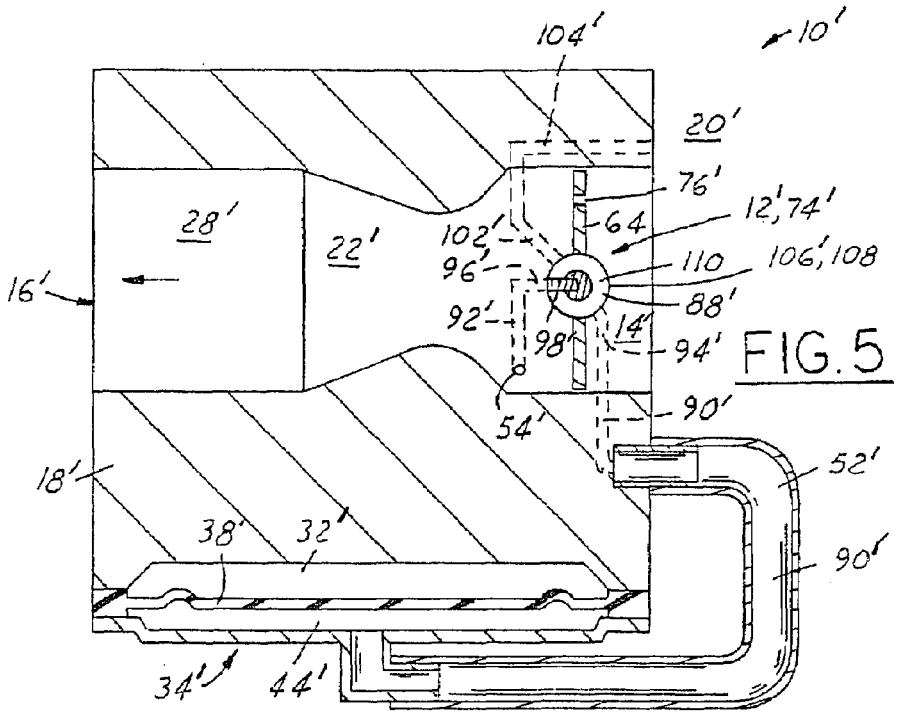
FIG. 5 is a cross-section of a modification of the charge forming apparatus of FIG. 1 illustrating an isolation valve integral to the throttling choke valve and shown in the open state when the throttling choke valve is in a closed position.
Figure 6:
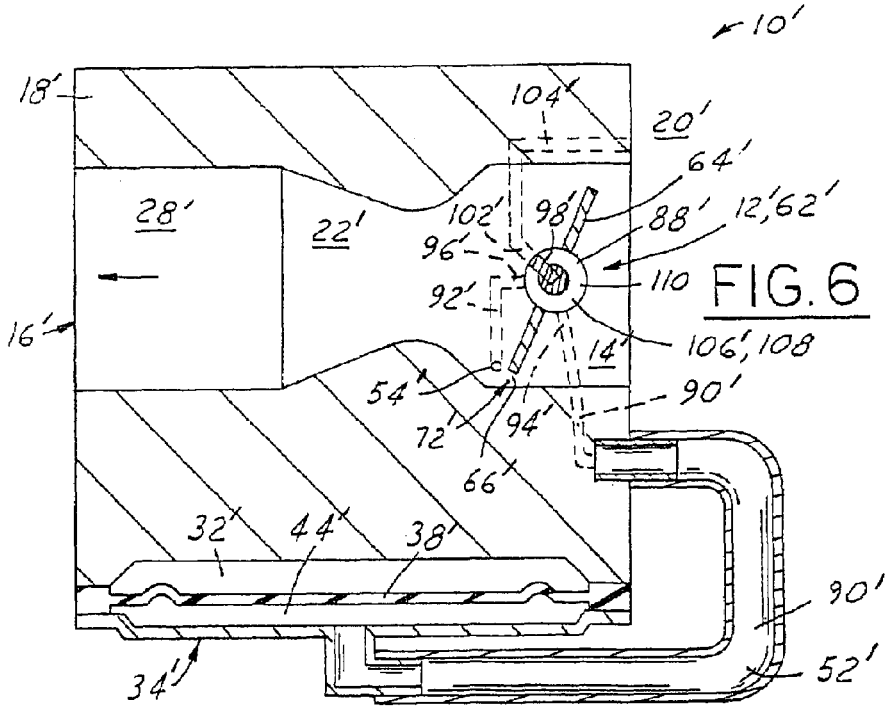
FIG. 6 is the cross-section of the charge forming apparatus of FIG. 5 illustrating the isolation valve in the closed state when the throttling choke valve is in the idle position.
Figure 7:
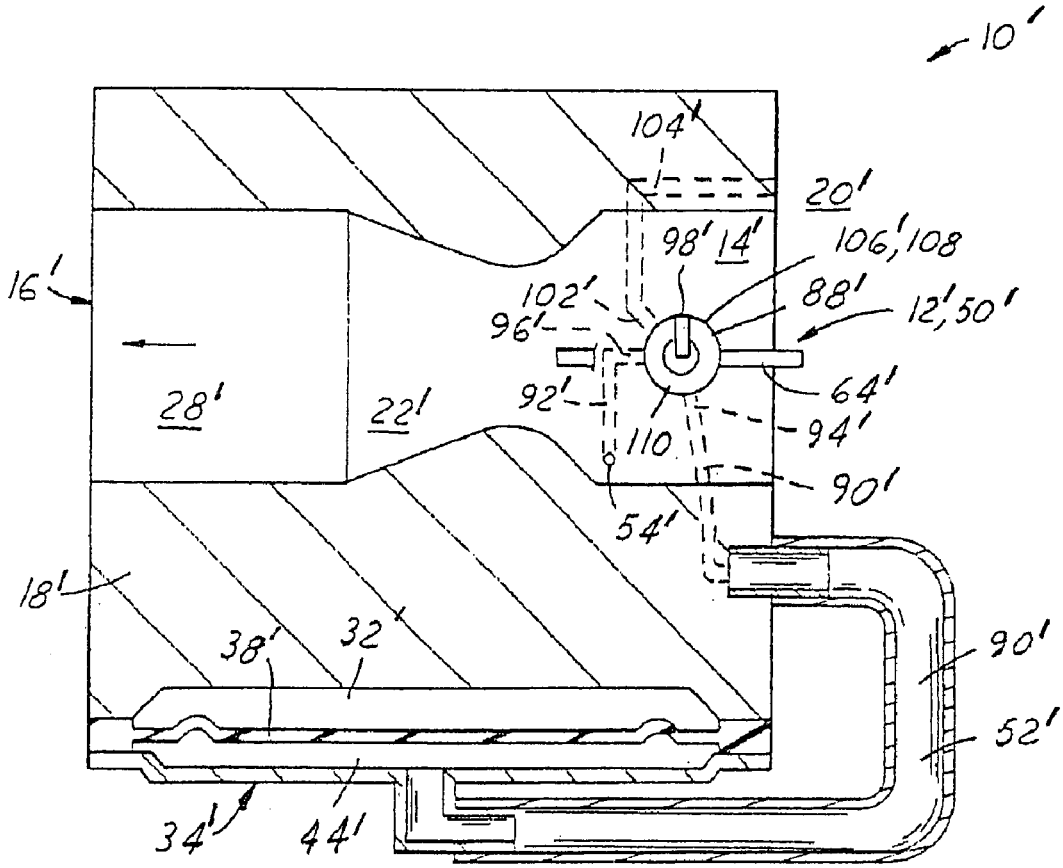
FIG. 7 is the cross-section of the charge forming apparatus of FIG. 5 illustrating the isolation valve in an open state when the throttling choke valve is in the open position.

FIGS. 5–7 illustrate a modified mechanical isolation valve 86' which replaces the solenoid actuated isolation valve 86 and is integrated with the rotating shaft 106' of the throttling choke valve 12'. The shaft 106' is rotatably seated within a bore 108 carried by the body 18' and extends transversely through the air inlet region 14'. The plate 64' of the throttling choke valve 12' is engaged rigidly to the shaft 106' and rotates or pivots with the shaft 106' between the closed and open positions 74', 50'. The valve chamber 88' is part of the bore 108' and is generally defined between the body 18' and the shaft 106' and is further isolated from the air inlet region 14' by a tight radial fit or close tolerance between the body 18' and a cylindrical portion of the shaft 106' disposed between the air inlet region 14' and the valve chamber 88'.

Like the solenoid-type isolation valve previously described, the reference port 94', the vent port 102' and the vacuum port 96' of the integrated isolation valve 86' are carried by the body 18' and disposed at the valve chamber 88'. Moreover, the vacuum port 96' is preferably disposed between, and spaced circumferentially apart from the reference and vent ports 94', 102'. A circumferentially extending recess 110 of the elongated shaft 106' is open radially outward and aligns axially to and is thus in communication with the valve chamber 88' of the bore 108. The recess 110 extends circumferentially approximately 340 degrees. The remaining twenty degrees, which has a circumferential surface which is flush with the outer cylindrical surface of the shaft 106', provides the valve head 98' of the rotating shaft 106'. The recess 110 is rotatably received in the bore 108 and sealed therewith adjacent its axial edges.

When the integrated throttling choke valve 12' is in the closed position 74' as best shown in FIG. 5, the recess 110 of the elongated shaft 106' is misaligned circumferentially to the vacuum port 96'. The valve head 98', which is aligned circumferentially to the vacuum port 96', isolates the vacuum port 96' and associated second leg 92' of the reference passage 52'. The reference chamber 44' is thus vented solely to the atmospheric air source 12' via the vent passage 104', the recess 110 and the first leg 90' of the reference passage 52'.

When the integrated throttling choke valve 12' is in the idle position 62', as best shown in FIG. 6, the recess 110 is misaligned circumferentially to the vent port 102'. The valve head 98', which is aligned circumferentially to the vent port 102', isolates the vent port 102' and associated vent passage 104'. The reference chamber 44 is thus exposed solely to the vacuum induced at the secondary venturi 72' via the first and second legs 90', 92' and the intersecting recess 102'.

When the integrated throttling choke valve 12 ' is in a position opened wider than the idle position 62', or is in the open position 50', as best shown in FIG. 7, the recess 110 is aligned circumferentially to the reference, vacuum and vent ports 94', 96', 102'. The valve head 98' is misaligned circumferentially to all the ports within the valve chamber 88'. Consequently, the reference chamber 44' is exposed to the atmospheric air source 20' via the first leg 90', the recess 110 and the vent passage 104', and is exposed to the pressure at the reference nozzle 54', which is near atmospheric pressure when the choke valve 12' is in the open position 50', via the second leg 92', the recess 110 and the first leg 90' of the reference passage 52'.

While the forms of the invention herein disclosed constitute presently preferred embodiments, many others are possible. It is not intended herein to mention all the possible equivalent forms or ramifications of the invention. It is understood that terms used herein are merely descriptive, rather than limiting, and that various changes may be made without departing from the spirit or scope of the invention.

I claim:

1. A charge forming apparatus for a combustion engine comprising:

a body;

a fuel-and-air mixing passage defined by the body, the mixing passage having a venturi region disposed between an air inlet region and a mixture outlet region, wherein air flows from a near atmospheric air source through the air inlet region and into the engine from the mixture outlet region;

a throttling choke valve disposed in the air inlet region of the mixing passage, the throttling choke valve having a closed position for starting of the engine, an idle position and a full open position;

a flexible diaphragm having a first surface, an opposite second surface, and a peripheral edge;

a fuel metering chamber defined between the body and the first surface;

a fuel feed passage communicating between the fuel metering chamber and the venturi region of the mixing passage, wherein liquid fuel flows into the venturi region for mixing with air flowing from the air inlet region;

a cover;

a reference chamber defined between the second surface and the cover, wherein the peripheral edge is engaged sealably between the cover and the body;

a reference passage communicating between the reference chamber and the air inlet region downstream of the throttling choke valve when in the idle position;

an air bypass channel communicating between the near atmospheric air source and the mixing passage downstream of the choke valve; and wherein the air bypass channel is dry and communicates directly with the mixture outlet region of the mixing passage and wherein the charge forming apparatus does not have a fuel idle circuit at the outlet region.

2. The charge forming apparatus set forth in claim 1 wherein the air bypass channel is defined by the body.

3. The charge forming apparatus set forth in claim 2 comprising an air bypass screw engaged threadably to the body and projecting adjustably into the air bypass channel for adjusting the air flow bypassing the throttling choke valve and the venturi region of the mixing passage.

4. A charge forming apparatus for an internal combustion engine comprising:

a body;

a fuel-and-air mixing passage defined by the body, the mixing passage having a venturi region disposed between an air inlet region and a mixture outlet region, wherein air flows from a near atmospheric air source through the air inlet region and into the engine from the mixture outlet region;

a throttling choke valve disposed in the air inlet region of the mixing passage, the throttling choke valve having a closed position for starting of the engine, an idle position and a full open position;

a flexible diaphragm having a first surface, an opposite second surface, and a peripheral edge;

a fuel metering chamber defined between the body and the first surface;

a fuel feed passage communicating between the fuel metering chamber and the venturi region of the mixing passage, wherein liquid fuel flows into the venturi region for mixing with air flowing from the air inlet region;

a cover;

a reference chamber defined between the second surface and the cover, wherein the peripheral edge is engaged sealably between the cover and the body;

a reference passage communicating between the reference chamber and the air inlet region downstream of the throttling choke valve when in the idle position; and an isolation valve constructed and arranged to vent the reference chamber to the near atmospheric air source when the throttling choke valve is not in the idle position.

5. The charge forming apparatus set forth in claim 4 wherein the isolation valve is in an open state when the throttling choke valve is not in the idle position and in a closed state when the throttling choke valve is in the idle position.

6. The charge forming apparatus set forth in claim 5 comprising:

a valve chamber of the isolation valve carried in-part by the body;

a first leg of the reference passage communicating between the reference chamber and the valve chamber;

a second leg of the reference passage communicating between the valve chamber and the air inlet region downstream of the throttling choke valve;

a vent passage defined by the body and communicating between the valve chamber and the near atmospheric air source; and wherein an actuating member of the isolation valve isolates the vent passage from the valve chamber when in the closed state.

7. The charge forming apparatus set forth in claim 6 wherein the isolation valve is a solenoid valve having a valve seat carried by the body within the valve chamber, a valve head being the actuating member constructed and arranged to engage the valve seat when in the closed state and disengage from the valve seat when in the open state.

8. The charge forming apparatus set forth in claim 7 wherein the solenoid valve is energized when in the closed state.

9. The charge forming apparatus set forth in claim 7 wherein the valve head moves linearly into the valve chamber.

10. The charge forming apparatus set forth in claim 6 wherein the isolation valve is integral to the throttling choke valve.

11. The charge forming apparatus set forth in claim 10 comprising:

a shaft of the throttling choke valve seated rotatably within a bore defined by the body which communicates transversely through the air inlet region of the mixing passage; and a pivoting plate of the throttling choke valve engaged rigidly to the shaft within the air inlet region for obstructing the air inlet region when in the closed position.

12. The charge forming apparatus set forth in claim 11 wherein the bore has the valve chamber and the rotating shaft is the actuating member of the isolation valve.

13. The charge forming apparatus set forth in claim 12 wherein the shaft carries a recess open radially outward and aligned axially to the valve chamber with respect to the bore.

14. The charge forming apparatus set forth in claim 13 wherein the vent passage is misaligned circumferentially to the recess and isolated from the valve chamber by the shaft when the isolation valve is in the closed state.

15. The charge forming apparatus set forth in claim 13 wherein the second leg of the reference passage is misaligned circumferentially to the recess and isolated from the valve chamber by the shaft when the isolation valve is in the open state and the throttling choke valve is in the closed position.

16. The charge forming apparatus set forth in claim 14 wherein the second leg of the reference passage is misaligned circumferentially to the recess and isolated from the valve chamber by the shaft when the isolation valve is in the open state and the throttling choke valve is in the closed position.

17. A carburetor for an internal combustion engine comprising:

a body;

a fuel-and-air mixing passage defined by the body, the mixing passage having a venturi region disposed between an air inlet region and a mixture outlet region, wherein air flows through the inlet region and into the engine from the outlet region;

a throttling choke valve disposed in the inlet region of the mixing passage, the throttling choke valve having a closed position for starting of the engine, an idle position and a full open position;

a fuel metering system for flowing liquid fuel via a fuel feed passage to the venturi region, said fuel metering system comprising a flexible diaphragm positioned between a fuel metering chamber and a dry reference chamber;

a reference passage comprising a reference nozzle communicating between the fuel metering system and the air inlet region downstream of the throttling choke valve when in the idle position; and wherein fuel flow through the fuel feed passage is reduced, but not stopped, when said dry reference chamber of the fuel metering system is exposed to negative pressure via the reference passage by movement of said throttling choke valve toward said reference nozzle.

18. The charge forming apparatus set forth in claim 17 comprising an air bypass channel communicating between the air inlet region upstream of the throttling choke valve and the mixture outlet region of the mixing passage.

19. A The charge forming apparatus for a combustion engine comprising:

a body;

a fuel-and-air mixing passage defined by the body, the mixing passage having a venturi region disposed between an air inlet region and a mixture outlet region, wherein air flows through the inlet region and into the engine from the outlet region;

a throttling choke valve disposed in the inlet region of the mixing passage, the throttling choke valve having a closed position for starting of the engine, an idle position and a full open position;

a fuel metering system for flowing liquid fuel via a fuel feed passage to the venturi region;

a reference passage communicating between the fuel metering system and the air inlet region downstream of the throttling choke valve when in the idle position;

wherein fuel flow through the fuel feed passage is reduced, but not stopped, when a dry reference chamber of the fuel metering system is exposed to negative pressure via the reference passage;

an air bypass channel communicating between the air inlet region upstream of the throttling choke valve and the mixture outlet region of the mixing passage; and an air bypass screw engaged threadably to the body and projecting adjustably into the air bypass channel for adjusting the air flow bypassing the throttling choke valve and the venturi region of the mixing passage.

20. A charge forming apparatus for a combustion engine comprising:

a body;

a fuel-and-air mixing passage having a venturi region disposed downstream of an air inlet region defined by a wall carried by the body;

a throttling choke valve disposed pivotally in the air inlet region;

a fuel metering system for flowing fuel via a fuel feed passage to the venturi region, wherein a negative pressure created in the venturi region promotes fuel flow through the fuel feed passage;

a reference passage communicating between the fuel metering system and the air inlet region downstream of the throttling choke valve, said reference passage comprising a reference nozzle;

a secondary venturi disposed upstream of the venturi region and defined by the throttling choke valve and the wall when said throttling choke valve moves toward said reference nozzle; and wherein a negative pressure created at the secondary venturi is transmitted to the fuel metering system via the reference passage for limiting fuel flow through the fuel feed passage.

21. The charge forming apparatus set forth in claim 20 wherein a throttle valve is not disposed downstream of the venturi region.

22. A charge forming apparatus for an internal combustion engine comprising:

a body a fuel-and-air mixing passage defined by the body, the mixing passage having a venturi region disposed between an air inlet region and a mixture outlet region;

a throttling choke valve disposed in the air inlet region of the mixing passage, the throttling choke valve having a closed position for starting of the engine, an idle position and a full open position;

a fuel metering system for flowing fuel via a fuel feed passage to the venturi region;

a reference passage communicating between the fuel metering system and the air inlet region downstream of the throttling choke valve when in the idle position wherein a negative pressure is applied to the fuel metering system via the reference passage for limiting fuel flow through the fuel feed passage when the throttling choke valve is in the idle position; and a minimum cross sectional flow area of the fuel feed passage being substantially larger than a minimum cross sectional flow area of the reference passage for providing a rich mixture of fuel-and-air to the combustion engine during cold start conditions.

* * * * *

UNITED STATES PATENT AND TRADEMARK OFFICE

CERTIFICATE OF CORRECTION

PATENT NO. : 7,028,993 B2
APPLICATION NO. : 10/625981
DATED : April 18, 2006
INVENTOR(S) : Michael P. Burns It is certified that error appears in the above-identified patent and that said Letters Patent is hereby corrected as shown below:

Column 11
Line 44, delete “The”.

Column 12
Line 39, after “body” insert a semicolon (;).

Signed and Sealed this

Twenty-first Day of November, 2006

JON W. DUDAS
*Director of the United States Patent and Trademark Office*